US005248898A

United States Patent [19]

Périou

[11] Patent Number: 5,248,898

[45] Date of Patent: Sep. 28, 1993

[54] DEVICE FOR THE CENTRALISED CONTROL OF THE OPENING POINTS OF A MOTOR VEHICLE

[75] Inventor: Pierre Périou, Cergy Pontoise, France

[73] Assignee: Rockwell Automotive Body Systems, France

[21] Appl. No.: 709,935

[22] Filed: Jun. 4, 1991

[30] Foreign Application Priority Data

Jun. 5, 1990 [FR] France ..... 90 06935

[51] Int. Cl.[5] ..... E05B 47/00

[52] U.S. Cl. ..... 307/10.1; 307/10.2; 180/289; 70/257; 70/264

[58] Field of Search ..... 307/10.1-10.5, 307/116, 130; 340/426-430, 825.31, 825.32, 825.34; 180/286, 287, 289; 361/171, 172, 187; 70/237, 256, 257, 264

[56] References Cited

U.S. PATENT DOCUMENTS 4,302,841 11/1981 McCulloch ..... 371/70
4,340,824 7/1982 Shaw ..... 307/115
4,440,006 4/1984 Kleefeldt ..... 70/264
4,883,974 11/1989 Tinder ..... 307/10.1
5,054,300 10/1991 Nakahara et al. ..... 70/262

*Primary Examiner*—Jeffrey A. Gaffin

[57] ABSTRACT

The invention relates to a device for the centrallized control of the opening points of a motor vehicle, in which the opening points have electrical actuators, including two locking states, and comprising at least one electric motor, and some opening points have a mechanically controlled device with a lock key sending commands to a central control unit which also receives commands coming particularly from the ignition key and/or from a remote-control set and from an anti-attack button. The device according to the invention is characterized in that the central control unit is connected to each of the opening points by a single line (8) with three conductors (31, 32, 33) which will be used sometimes for power transfer and sometimes for information transfer, in that in each opening point the actuator is connected permanently between the three conductors of the said line (8), and in that the central control unit selectively applies to each of the said conductors (31, 32, 33) the voltages necessary for the execution of a sequence.

1 Claim, 4 Drawing Sheets

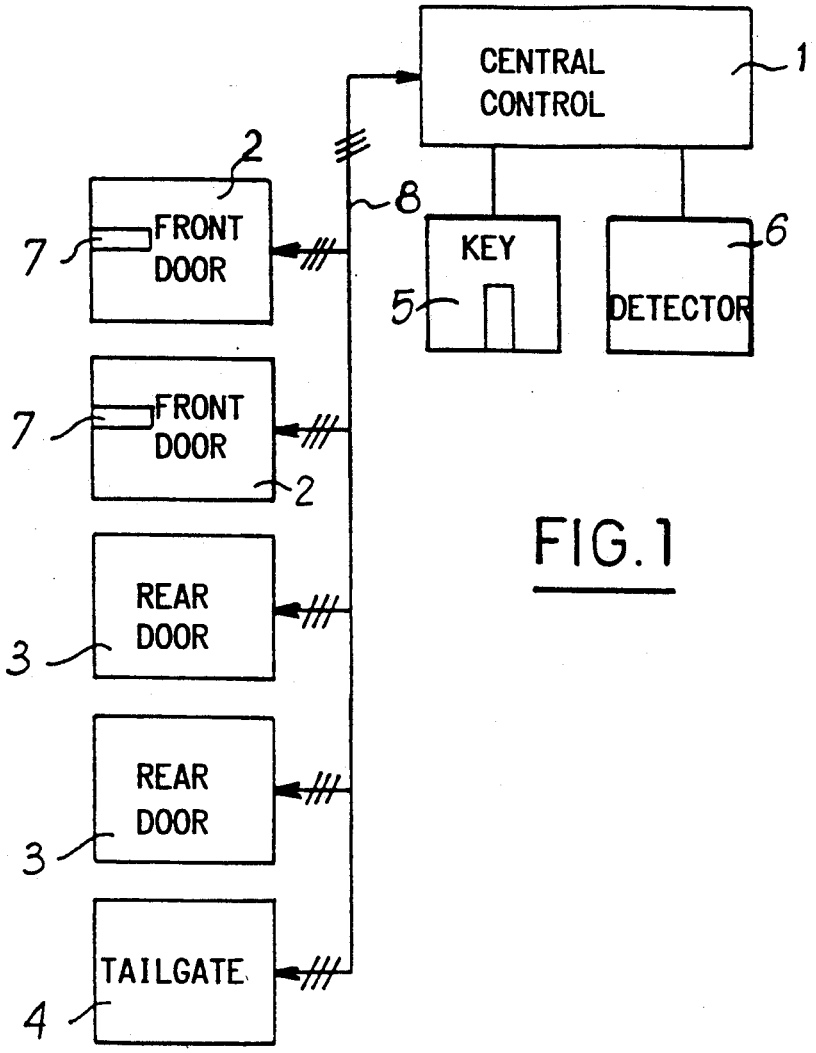
FIG. 1
FIG. 2
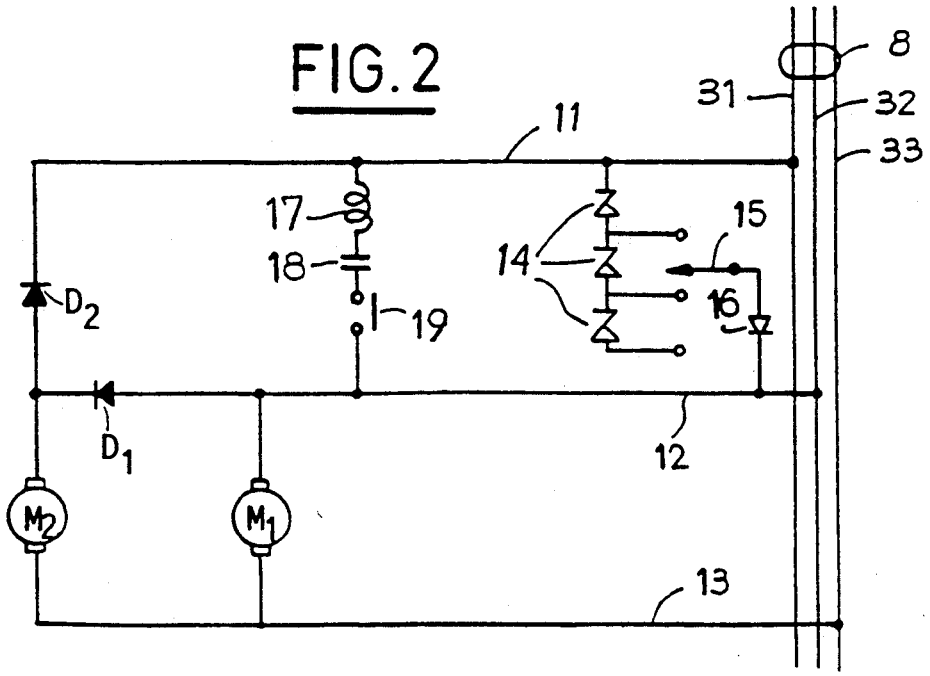

DEVICE FOR THE CENTRALISED CONTROL OF THE OPENING POINTS OF A MOTOR VEHICLE

BACKGROUND OF THE INVENTION

1. Field of the Invention

The present invention relates to a device for the centralised control of the opening points of a motor vehicle. It is intended for controlling the door locks, the trunk and other protected-access devices, such as the petrol flap, the glove box, etc.

2. Description of the Related Art

The control of the locking or unlocking of these various opening points or accesses is centralised, that is to say it can be controlled by the actuation of the key in the lock of one of the front doors or of the boot, by remote control or by an anti-attack button.

The door locks have two locking states, namely a first "secure" state, in which the door is locked, and a second "super secure" state which corresponds to a locking mode in which the lock is unpickable and can be only electrically unlocked.

In systems with a centralised control, the action of the key in the lock of one of the front doors generates electrical signals which are transmitted to a central control unit which sends a "secure" or "desecure" command to all the opening points or protected accesses.

This central control unit can also receive a "secure", or "desecure" signal transmitted by a remote command made from outside the vehicle or by an anti-attack button.

Moreover, in motor vehicles there is generally an alarm device warning the driver that one of the protected accesses is improperly closed and visually designating the access which is improperly closed. The indication of improper closure is provided by a contactor which is most often located in the lock and is called an O.D.C. or open-door contactor.

As a result of this, to perform all these functions it is necessary to connect a large number of conductors to each protected access; this number can rise to eight for a front door having a "super secure" system. Now the operation of electrically wiring of a motor-vehicle opening point is difficult and remains expensive.

The object of the invention is, therefore, to provide a device for the centralised control of the opening points of a motor vehicle, which makes it possible to considerably reduce the number of conductors necessary for the connection between the opening points and the central control unit.

SUMMARY OF THE INVENTION

The subject of the invention is a device for the centralised control of the opening points of a motor vehicle, in which the opening points have a double- or triple-effect electrical actuator comprising at least one electric motor, and some opening points have a mechanically controled device with a lock key sending commands to a central control unit which also receives commands coming particularly from the ignition key and/or from a remote control set and/or from an anti-attack button, characterised in that the central control unit is connected to each of the opening points by means of a single line with three conductors used sometimes for power transfer and sometimes for information transfer, in that in each opening point the actuator is connected permanently between two or three conductors of the said line, and in that the central control unit comprises means for selectively applying to each of the said conductors the voltages necessary for the execution of a sequence.

According to another characteristic of the invention, in the opening points having a mechanical control with a lock key, a series of passive electronic voltage-level setting components is connected between two conductors contactlessly in the position of rest.

Any "secure" or "desecure" command by the key defines a position of the said key which closes the circuit by means of one or more of the abovementioned components and the two conductors, one biased at the positive voltage of the source by means of a resistor and the other connected to earth. The central unit comprises a detector of the level of voltage tapped at the terminal of the resistor adjacent to the components; this detector supplies control signals to the means for applying to the three conductors the polarities corresponding to the request.

The invention will be better understood from the following description given purely by way of example and made with reference to the accompanying drawings in which:

BRIEF DESCRIPTION OF THE DRAWINGS

FIG. 1 is a block diagram of an embodiment of the invention;

FIG. 2 is a diagram of the circuit located in a front opening point;

DETAILED DESCRIPTION OF THE PREFERRED EMBODIMENT

Figure 3:
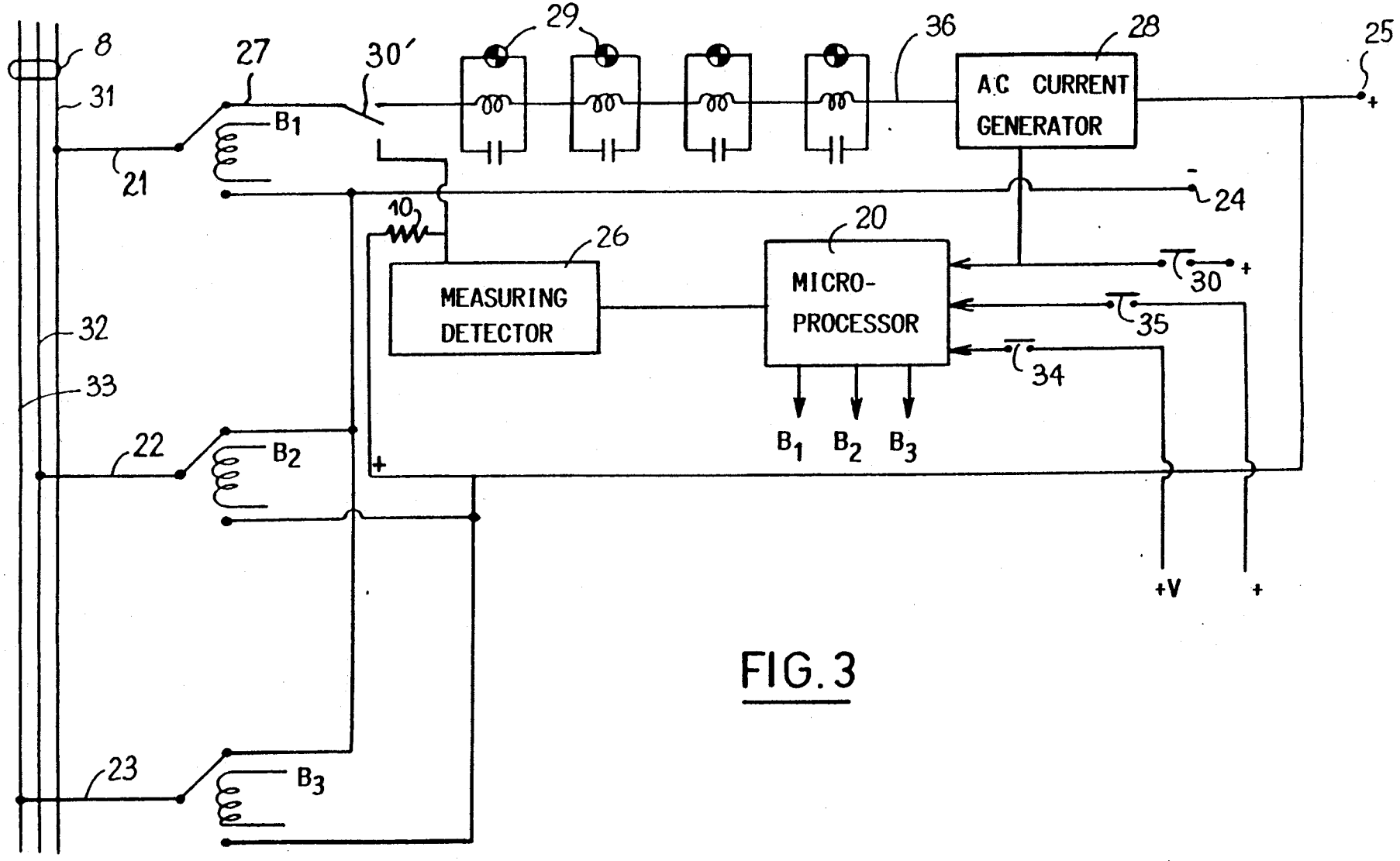
FIG. 3 is a block diagram of the central control unit.

FIG. 1 is a general block diagram of a device according to the invention which comprises essentially a central control unit 1 intended for controlling the "desecuring", "securing" or "super securing" of opening points, such as front doors 2, rear doors 3 and a tailgate 4. The central control unit can receive commands sent by the mechanism of the ignition key 5, a remote-control receiver 6 or an anti-attack button.

The two front doors 2 are equipped with a key lock 7 which is fitted with electrical contacts supplying electrical signals to the central control unit 1 for the purpose of "desecuring", "securing" or "super securing" the opening points.

The structure of the various elements of this diagram is such that the connection between the central unit 1 and the various opening points is made simply by means of a line 8 with three conductors 31, 32, 33 which forms a kind of bus junction between the central control unit 1 and the opening points, each of these being connected in parallel to the line 8.

FIG. 2 is an electrical diagram of the circuit contained in an opening point, such as a front door. This circuit essentially comprises three conductors 11, 12, 13, each connected to one of the conductors of the line 8 (control by key can take place, for example, between 11 and 12).

Each opening point comprises a triple-effect electrical actuator, for example two direct-current motors M1 and M2; the motor M1 controls the "securing" or "desecuring" of the opening point, and the motor M2 controls the "super securing" or "desecuring" of the lock.

In the "super secure" position, the door cannot be opened by using the mechanical control elements of the door, namely a lever or pusher, but only by an electrical control provided by the insertion of a coded key into the lock 7 or by a remote command received by the detector 6.

According to the invention, for each actuator, the motors M1 and M2 are connected permanently between the three conductors 11, 12 and 13. In the example illustrated, the motor M1 is connected between the conductor 13 and the conductor 12. The second motor M2 is likewise connected between the conductors 13 and 12. On this conductor 12, a diode D1 separates the terminals of the motors M1 and M2, and the cathode of D1 is connected to M2. Moreover, the terminal of M2 joined to the conductor 12 is extended on the conductor 11 by a diode D2, the cathode of which is connected to this conductor 11. The control takes place between the conductors 11 and 12. From the conductor 11 an assembly of three electronic components is connected, in the illustrated example Zener diodes 14 connected in series. From the anodes of these Zener diodes, three terminals are defined for a switch.

The other conductor 12 is connected to the common terminal of a three-position switch 15 by means of a diode 16, the cathode of which is connected to the conductor 12. The function of the diode 16 is to prevent a power current from passing through the Zener diodes if a key request occurs during a power transfer for "super securing". This three-position switch consists, in fact, of the coded key inserted into the lock 7; the three possible positions of the lock key 15 correspond to the three abovementioned states of "desecure", "secure" and "super secure". This switch closes a circuit via one or more Zener diodes according to the particular request.

Finally, a resonant circuit consisting of a coil 17 and of a capacitor 18 is connected between the two conductors 11 and 12, with the interposition of a contact 19 which corresponds to the open-door contactor O.D.C. and which is closed when the door is open or improperly closed.

The electrical circuit integrated in the other opening points, such as the rear doors or the tail gate, does not include the elements 14 to 16 corresponding to the key lock 7.

FIG. 3 illustrates the circuit of the central control unit in simplified form. The line 8 is connected to three inputs 21, 22 and 23 which correspond respectively to the conductors 11, 12 and 13 of each of the opening points. Each of these inputs is connected to the contact of a control relay, B1, B2 and B3 respectively, these being shown in the state of rest. The coils of the relays B1, B2 and B3 are controlled by a microprocessor 20, as will be described in detail later. In the state of rest corresponding to the vehicle left unattended, the terminal 23 corresponding to the conductor 33 of the line 8 and the terminal 22 corresponding to the conductor 32 of the line 8 are connected to the negative terminal 24 of the vehicle's supply battery. When the relays B2 and B3 are energised into the working position, the terminals 22 and 23 are connected to the positive terminal 25 of the vehicle battery.

When the relay B1 is energised, the terminal 21 corresponding to the conductor 31 of the line 8 is connected to the negative terminal 24 of the battery. In the position of rest, the terminal 21 is connected to a measuring detector 26 which supplies information to the microprocessor 20. This terminal 21 is biased at the positive voltage by a resistor 10 which is connected to the conductor 21 by means of the break contact 27 of the relay B1 and the make contact of a switch 30' controlled by the actuation of the ignition key.

Moreover, when the vehicle is being used. with the ignition key inserted, the break contact 27 of the relay B1 can also be connected to an alternating-current generator 28 either by means of trap circuits connected in series or by means of a resistor, in which case the string of trap circuits can be connected in parallel between 12 and 13 or omitted. Each of these trap circuits is tuned to the resonant frequency of the resonant circuit 17, 18 of one of the opening points. An alarm device, such as an indicator lamp 29, is connected in parallel to each of the resonant circuits. This indicator lamp can consist, for example, of a light-emitting diode.

The putting into operation of the generator 28 is controlled by a signal occurring as a result of the closing of a contact 30 which is closed by the ignition key of the vehicle and which corresponds to the circuit 5 of FIG. 1.

The microprocessor 20 also receives from the contact 30 information on the insertion of the ignition key of the vehicle. It also receives information by means of an anti-attack contact 34 which can be closed by the user when he is in the vehicle. Finally, the microprocessor 20 receives a "secure", "super secure" or "desecure" command provided by means of a contact 35 associated with the remote-control detector 6.

Figure 4:
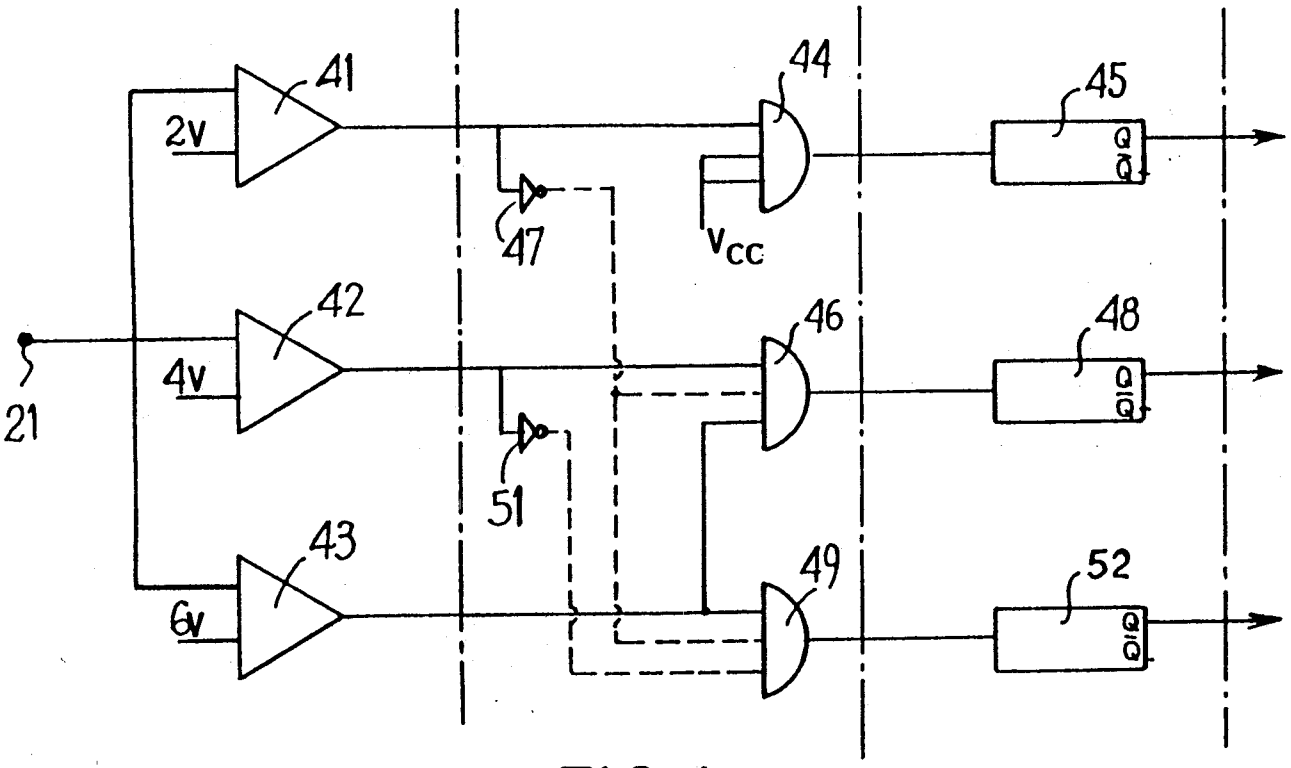
FIGS. 4 and 5 are detailed diagrams of the central control unit.

FIG. 4 is a detailed diagram representing the detector circuit 26. The signal coming from the measuring conductor 31 is sent to three operational amplifiers 41, 42 and 43 which, in addition, each receive a nominal value matched to the voltages of the Zener diodes 14.

In the example illustrated, these reference signals are respectively equal to 2, 4 and 6 volts. The signal supplied by the first operational amplifier 41 is sent to an AND gate 44 with three inputs, the other two inputs of which receive a positive voltage corresponding to the logical state 1. The output of the logical AND gate 44 is sent to a monostable multivibrator 45, the output of which supplies a first command signal.

The output of the second operational amplifier is sent to a logic AND circuit 46 with three inputs; the second input of this circuit receives the output signal from the operational amplifier 43 and the third input of this circuit receives the inverted output signal from the comparator 41, the inversion being carried out by an inverting gate 47. The output of this logic AND circuit 46 controls a second monostable multivibrator 48, the output of which likewise supplies a command signal.

The output of the operational amplifier 43 is sent to a logical AND circuit 49 with three inputs, the other two inputs of which receive respectively the inverted output signal from the operational amplifier 41 and the inverted output signal from the operational amplifier 42 by means of an inverting gate 51. The output of the logical AND circuit 49 controls a third monostable multivibrator 52, the output of which likewise supplies a command signal.

Figure 6:
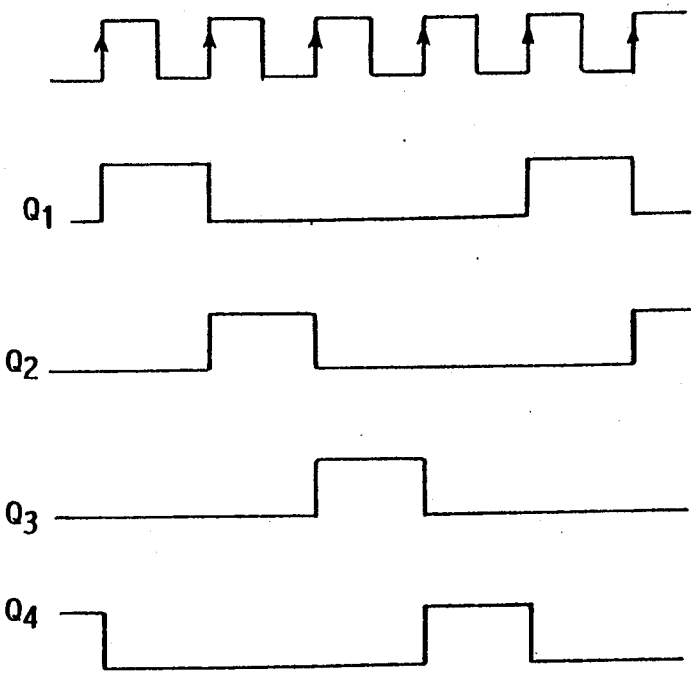
FIG. 6 is a graph explaining FIG. 5.
Figure 5:
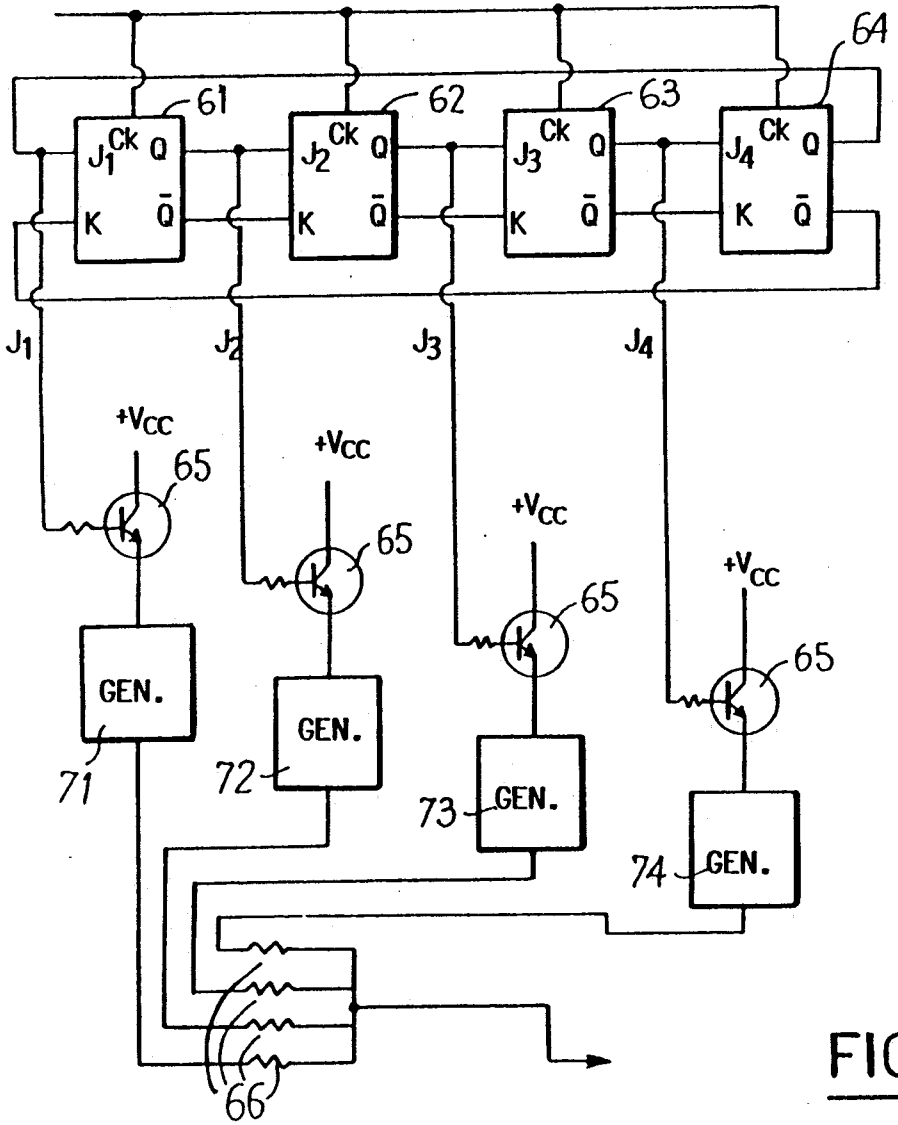

FIG. 5 is a diagram showing the generator 28 in detail. It consists essentially of four multivibrators 61, 62, 63 and 64 which are connected in series so as to constitute a ring counter; FIG. 6 is a timing diagram respectively representing clock signals sent to each of the multivibrators and their output Q.

The output signal Q of each of the multivibrators controls a transistor 65 which forms a switch arranged between the direct-voltage source and the feed wire of each periodic-signal generator 71, 72, 73 and 74. The output of each of these generators is sent to the conductor 36 of FIG. 3 upstream of the trap circuits.

The frequencies of the signals supplied by the generators 71 to 74 correspond respectively to the resonant frequencies of each of the resonant-circuit assemblies 17, 18 of the gate circuit and corresponding trap circuit assembly of the central control unit.

The device which has just been described operates as follows. When the door key is inserted into the lock 7, this key can assume the three positions of the switch 15. The voltage of the Zener diodes 14 is selected so as to be slightly below the triggering threshold of the comparators 41 to 43; thus, if a Zener diode voltage slightly below 2 volts is selected, the triggering of the comparators 41, 42 and 43 will be obtained when only one of the Zener diodes 14 is connected by the switch 15, the triggering of the comparators 42 and 43 when two diodes are connected and the triggering of the comparator 43 when the three Zener diodes 14 are connected by the switch 15.

In the absence of a request by the key in the lock 7, the voltage read off by the detector 26 is the battery voltage which is sent from the terminal 25 via the resistor 10.

Since this voltage is higher than the maximum threshold of 6 V, none of the comparators 41 to 43 changes from the logical value "0" to the logical value "1". No command is sent to the coils of the relays B1, B2 and B3. If the key is inserted into the lock 7 and is actuated in the "desecuring" direction, the contact corresponds to the connecting of the three Zener diodes 14 in series and only the comparator 43 supplies a logical "1" at its output, thereby unblocking the logical AND gate 49 which changes to 1 and activates the multivibrator 52 which provides a command for activating the coil of the relay B2. The effect of this is to apply the positive supply voltage to the conductor 32 of the bundle 8 and consequently to the control line 12. The motor M1 and the motor M2 by means of the diode D1 are thus fed in the "desecuring" direction in each of the doors controlled by the central control unit.

If the door key is actuated in the "securing" direction, there are two positions, the first corresponding to the normal "securing" of the doors and the second to "super securing". These two positions can be two successive positions of the key or the second position can correspond to keeping the key in the "securing" position for a given time.

If the door key is actuated in order to obtain "securing", the position corresponding to two diodes 14 in series is obtained and the two comparators 42 and 43 change to the logical state "1"; the inverter 51 blocks the AND gate 49 and only the gate 46 changes to the logical state "1", thereby activating the multivibrator 48 which controls the supply to the coil of the relay B3. The result of this is that the motor M1 is fed in the opposite direction to the "desecuring" direction. The motor M2 is not actuated because its two terminals are connected to the same positive supply potential and D1 opposes the passage of current towards 32.

Finally, if the key changes to the "super secure" position, only the first Zener diode 14 is connected to the measuring circuit and the comparators 41, 42 and 43 change to the logical state "1". The output of the comparator 41 blocks the gates 46 and 49 by means of the inverting circuits 47 and 51. The result of this is that only the gate 44 is unblocked, thereby actuating the multivibrator 45 which controls the supply to the coil of the relays B1 and B3. In this case, the positive voltage is applied to the conductor 13, the other conductors being connected to the negative terminal; the motor M1 is actuated in the "securing" direction and the motor M2 is likewise actuated in the "securing" direction, the combination constituting the "super secure" facility.

The diodes D1 and D2 make it possible to isolate or select M2 according to the polarities applied to the three conductors, this allowing it to be put at rest in the event of a request for simply "securing" when M1 alone is activated.

Should there be two simultaneous key requests, the lowest Zener diode voltage has priority, thus determining priority in the event of two simultaneous different key requests. In the example given, the "super secure" request corresponding to the lowest Zener diode voltage has priority over the other commands. The same is true of the "secure" command which has priority over a "desecure" command. This is a choice which can be changed as desired. This and protections on the monostable multivibrators prevent the transmission of two different simultaneous commands.

The Zener diodes 14 can be replaced by other electronic components dividing a voltage applied to the terminals of the two conductors. It would be possible, for example, to use three resistors of different values connected in parallel between the conductor 11 and the movable contact of the switch 15, each resistor forming a voltage divider bridge with the resistor 10, the free ends of the resistors forming three contact studs of the switch.

The microprocessor 20 can also be controlled by the remote control represented diagrammatically by the contact 35 which supplies "desecuring" or "securing" information to the microprocessor 20.

The device according to the invention also comprises an anti-attack device represented diagrammatically by the contact 34 which is actuated by the occupant of the vehicle when he is inside this and which likewise transmits "securing" command information to the microprocessor 20.

The microprocessor 20 also receives information relating to the ignition key of the vehicle (contact 30). The information provided as a result of the actuation of the ignition key of the vehicle allows the actuation of the anti-attack device and inhibits the remote control. Furthermore, the actuation of the ignition key of the vehicle commands the monitoring procedure of the door contacts by activating the generator 28 which therefore operates only when the ignition key is in the active position. This position cancels the positive direct voltage applied to the control conductor 21 which is thus subjected to the periodic signals supplied by the generator 28.

Should a door "securing" or "desecuring" command be transmitted during this monitoring as a result of the actuation of the anti-attack device, the monitoring is interrupted for a brief moment by the microprocessor 20 for the purpose of execute the command.

The monitoring of the state of closure of the doors is carried out by using two conductors only, namely the conductors 31–32.

As can be seen by referring to FIGS. 5 and 6, the generator supplies a train of pulses of different frequencies which correspond respectively to the resonant frequencies of the resonant-circuit/trap-circuit pairs of the central control unit and of each door.

If one of the door contacts 19 is closed, the current circulates via the two conductors 11 and 12, there is a drop of impedance of the resonant circuit to the resonant frequency of the door in question, and the result of this is that the voltage at the terminals of the corresponding trap circuit of the central control unit assumes a higher value, thereby actuating the alarm consisting, for example, of the indicator lamp 29 which flashes at the cyclic frequency of the generator 28.

According to another embodiment of the invention, the generator 28 supplies a complex voltage comprising a plurality of equal voltages, the frequencies of which correspond to the frequencies of the resonant circuits. In this case, a summing circuit can be used to send all the frequencies along the conductor 11. In this case, the four signal generators are supplied continuously and the ring counter is no longer used.

It can be seen that, when the vehicle is at a standstill (no ignition contact made), a positive voltage is applied to the control conductor 11, 21, 31 and that, even if a door is improperly closed, with a contact 19 closed, no current will circulate in the two control conductors 11 and 12 because the capacitor of the resonant circuit of the improperly closed door forms a direct-current switch.

According to another embodiment of the invention, a single-frequency generator is provided in the central control unit only, and in each door the series resonant circuit is replaced by a vibrator operating at the frequency supplied by the generator of the central control unit.

This embodiment makes it possible to limit the space required on the dashboard by numerous indicator lamps. However, a single indicator lamp constituting a permanent alarm can be provided, whilst the operation of the vibrator is delayed and the sound signal ceases after a particular time.

To prevent current consumption when ignition contact is not made and a positive direct voltage is sent along the first control conductor 11, a capacitor can be arranged in series with each of the vibrators. Since the indicator of an improperly closed door is in the door itself, the attention of the occupants is gained much more quickly, above all where rear doors are concerned.

According to another embodiment of the invention the trap circuits are omitted and the generator 28 permanently sends periodic wave trains of different frequencies cyclically. These signals pass through a resistor arranged in series with the generator 28 in the central unit. Together with the impedance of the resonant circuits, this resistor performs the function of a voltage divider bridge: the amplitude of each of the signals passing through it is seen at its terminal adjacent to the conductor 21. In the absence of an improperly closed door, the amplitude of the signal at the abovementioned terminal is that of the signal transmitted by the generator 28. From the moment when a door contact 19 closes, this amplitude falls in the manner of a voltage divider bridge for the signal to the resonant frequency of the improperly closed door. An alarm is triggered as soon as this variation in voltage amplitude is detected. Since any signal at a given frequency is transmitted periodically for a $\frac{1}{4}$ period as a result of the supply of the system by the ring counter (see FIG. 5), in the event of a voltage drop it is known exactly which door is involved since a door is sensitive to its natural frequency and not to the other frequencies transmitted for the other doors during the remaining $\frac{3}{4}$ of the period. The period is divided into as many portions as there are doors to be monitored (4 here in the example given).

According to another embodiment of the invention, it is also possible to arrange the series of trap circuits in parallel between the two conductors 21 and 22 in the central unit, that is to say between the output 36 of the generator connected to the conductor 21 and the negative polarity of the battery connected to the conductor 22. The generator 28 permanently sends the periodic wave trains at the various frequencies cyclically via a resistor. When its natural frequency is received, each trap circuit has a high impedance. As soon as the door contact 19 of the corresponding resonant circuit is closed, the impedance at the terminals of the said trap circuit falls, and the same is true of the voltage at its terminals. An alarm is triggered as soon as this voltage drop is detected.

It can be seen that the invention, using only three junction conductors forming a bus between the central control unit and each of the opening points, makes it possible to control in a centralised manner the opening, "securing" and even "super securing" of the doors and to send from each of the doors the necessary commands provided by the door key.

Another advantage of the invention is that only passive elements are accommodated in the doors, this being important from the point of view of cost and reliability.

Moreover, two of these conductors are sufficient to carry out the monitoring of the state of closure of all the opening points, with the improperly closed door being indicated each time.

The invention also applies to opening points comprising a double-effect actuator, such as opening points without "super securing" (luggage boot, petrol flap etc.). In this case, if the actuator is a reversible motor, it will be connected permanently between two conductors.

I claim:

1. Device for the centralized control of opening points (2, 3, 4) of a motor vehicle, in which the opening points have electrical actuators (M1, M2) comprising at least one electric motor, and a mechanically controlled device with a lock key (7) sending commands to a central control unit (1) which also receives commands coming from the ignition key (5) and/or from a remote-control set (6) and/or from an anti-attack button, characterised in that the central control unit (1) is connected to each of the opening points (2, 3, 4) by means of a single line (8) with three conductors (31, 32, 33) for power transfer and for information transfer, each opening point (2, 3, 4) and the actuators (M1, M2) are connected permanently between the three conductors of the said line (8), and in that the central control unit (1) comprises means (20, 26, B1, B2, B3) for selectively applying to each of the said conductors (31, 32, 33) the voltages necessary for the execution of a sequence and further characterised in that the actuators comprise a first motor (M1) connected between two conductors (12, 13) of the line (8) and a second motor (M2) connected directly to one of said two conductors (12, 13) and connected to the other of these conductors through a first diode (D1), the cathode of which is connected to the said second motor, and a second diode (D2) is connected between the terminal of the second motor (M2) and said third conductor (11) of the line (8), the anode of this second diode being connected to the second motor (M2).

* * * * *